US011566404B2

(12) United States Patent
Peng et al.

(10) Patent No.: US 11,566,404 B2
(45) Date of Patent: Jan. 31, 2023

(54) PULL-OUT FAUCET HAVING MAGNETIC ATTRACTION

(71) Applicant: HARDA (XIAMEN) PLASTIC CO., LTD., Xiamen (CN)

(72) Inventors: Kesheng Peng, Xiamen (CN); Lianhua Mao, Xiamen (CN); Yulin Qiu, Xiamen (CN)

(73) Assignee: HARDA INTELLIGENT TECHNOLOGIES CO., LTD., Xiamen (CN)

( * ) Notice: Subject to any disclaimer, the term of this patent is extended or adjusted under 35 U.S.C. 154(b) by 222 days.

(21) Appl. No.: 16/898,446

(22) Filed: Jun. 11, 2020

(65) Prior Publication Data

US 2021/0388583 A1 Dec. 16, 2021

(51) Int. Cl.
*E03C 1/04* (2006.01)

(52) U.S. Cl.
CPC .... *E03C 1/0404* (2013.01); *E03C 2001/0415* (2013.01)

(58) Field of Classification Search
CPC ..... E03C 1/0404; E03C 2001/0415
USPC ..... 4/678
See application file for complete search history.

(56) References Cited

U.S. PATENT DOCUMENTS

2008/0185060 A1* 8/2008 Nelson ..... B05B 15/65 285/8
2014/0251451 A1* 9/2014 Yang ..... E03C 1/0404 137/315.01
2019/0040611 A1* 2/2019 Zhu ..... E03C 1/0404

* cited by examiner

*Primary Examiner* — Huyen D Le
(74) *Attorney, Agent, or Firm* — Leong C. Lei

(57) ABSTRACT

A pull-out faucet includes a faucet spout, a braided hose that is movably disposed in the faucet spout, a coupling member that is disposed in the faucet spout and hermetically connected to an outlet end of the braided hose, and a fixing assembly. The fixing assembly includes a fixing seat disposed in the faucet spout, a first fixing member secured in the fixing seat, and a second fixing member having a magnetic attraction with the first fixing member. The fixing seat has a central first through hole. The second fixing member is installed on the coupling member. The coupling member is attracted and secured on the fixing assembly.

12 Claims, 12 Drawing Sheets

PULL-OUT FAUCET HAVING MAGNETIC ATTRACTION

BACKGROUND OF THE INVENTION

1. Field of the Invention

The present invention relates to a pull-out faucet, and more particularly to a pull-out faucet having magnetic attraction.

2. Description of the Prior Art

A conventional pull-out faucet on the market usually includes a spray head, a braided hose, a faucet spout, a weight device, and a faucet body. The braided hose is disposed in the faucet spout. One end of the braided hose is hermetically connected to the outlet end of the faucet body and equipped with the weight device. The spray head is hermetically connected to the outlet end of the braided hose and fitted at the outlet end of the faucet spout. When in use, the spray head is pulled out from the faucet spout by overcoming the gravity of the weight device, and then the valve is opened through the faucet body for use as desired. After use, the spray head is released, under the action of the weight of the weight device, the braided hose pulls the spray head toward the faucet spout, and the spray head is positioned at the outlet end of the faucet spout, so as to return the spray head.

However, due to the precision limitation of the parts and the influence of friction between the components, this pull-out faucet cannot guarantee that the spray head can be positioned and attached to the outlet end of the faucet spout every time. As a result, the spray head cannot be returned accurately, and there is a space between the spray head and the faucet spout, which causes the spray head to easily shake on the faucet spout and affects the practicality of the product.

Accordingly, the inventor of the present invention has devoted himself based on his many years of practical experiences to solve these problems.

SUMMARY OF THE INVENTION

The primary object of the present invention is to provide a pull-out faucet having magnetic attraction that can return a spray head accurately.

In order to achieve the above object, the present invention adopts the following technical solutions:

A pull-out faucet comprises a faucet spout, a braided hose that is movably disposed in the faucet spout, a coupling member that is disposed in the faucet spout and hermetically connected to an outlet end of the braided hose, and a fixing assembly. The fixing assembly includes a fixing seat, a first fixing member, and a second fixing member having a magnetic attraction with the first fixing member. The fixing seat is disposed in the faucet spout and has a central first through hole. The coupling member is movably inserted through the first through hole. The first fixing member is secured in the fixing seat. The second fixing member is installed on the coupling member.

Preferably, the coupling member includes a ball joint having a second through hole and a flared joint having a central mounting hole. An inlet end of the ball joint is hermetically connected to the outlet end of the braided hose. An outlet end of the ball joint is hermetically connected to the flared joint. The second through hole of the ball joint communicates with the mounting hole of the flared joint.

Preferably, the ball joint and the flared joint are an integral structure.

Preferably, the second fixing member is installed on the ball joint and/or the flared joint.

Preferably, the second fixing member is installed on the ball joint and is arranged obliquely with respect to an axis of the ball joint. The first fixing member is parallel with the second fixing member.

Preferably, the second fixing member is installed on an outside of the flared joint and is movably inserted through the first through hole in the fixing seat.

Preferably, the first fixing member and the second fixing member are magnets; or one of the first fixing member and the second fixing member is a stainless iron, and the other is a magnet.

Preferably, the first fixing member is a magnet, the second fixing member and the ball joint are stainless irons, and the second fixing member and the ball joint are an integral structure.

Preferably, the first fixing member is a magnet, the second fixing member and the flared joint are stainless irons, and the second fixing member and the flared joint are an integral structure.

Preferably, a bottom of the fixing seat is provided with a positioning protrusion, a bottom of an outlet end of the faucet spout is provided with a positioning notch, and the positioning protrusion is movably engaged in the positioning notch.

Preferably, one side of the fixing seat is provided with an elastic engaging seat, one side of the faucet spout is provided with an engaging hole, and the elastic engaging seat is detachably connected to the engaging hole.

Preferably, the fixing assembly further includes a sleeve, the sleeve is fitted on the coupling member and placed on an upper end face of the second fixing member, and a space is defined between the sleeve and the coupling member for the braided hose to be inserted therein.

When the pull-out faucet with magnetic attraction provided by the present invention is used, the spray head is pulled out from the faucet spout by overcoming the gravity of the weight device, and then the valve is opened through the faucet body for use as desired. After use, the spray head is released, under the action of the weight of the weight device, the braided hose pulls the spray head to the outlet end of the faucet spout through the coupling member. At this time, the coupling member also approaches the fixing assembly that is fixed inside the outlet end of the faucet spout. At the same time, the second fixing member on the coupling member also approaches the first fixing member on the fixing assembly. When the distance is within the action range of the magnetic force, the magnetic force together with the weight of the weight device will pull the coupling member towards the fixing assembly. Through the magnetic attraction between the first fixing member and the second fixing member, the coupling member is attracted and secured on the fixing assembly. First, this can avoid the defect that the friction between the components causes the weight of the weight device to fail to accurately return the spray head fixed on the coupling member to the faucet spout. Secondly, it also avoids the defect that the spray head positioned on the faucet spout shakes to affect the use.

DETAILED DESCRIPTION OF THE PREFERRED EMBODIMENTS

In order to further explain the technical solution of the present invention, embodiments of the present invention will now be described, by way of example only, with reference to the accompanying drawings.

Figure 1:
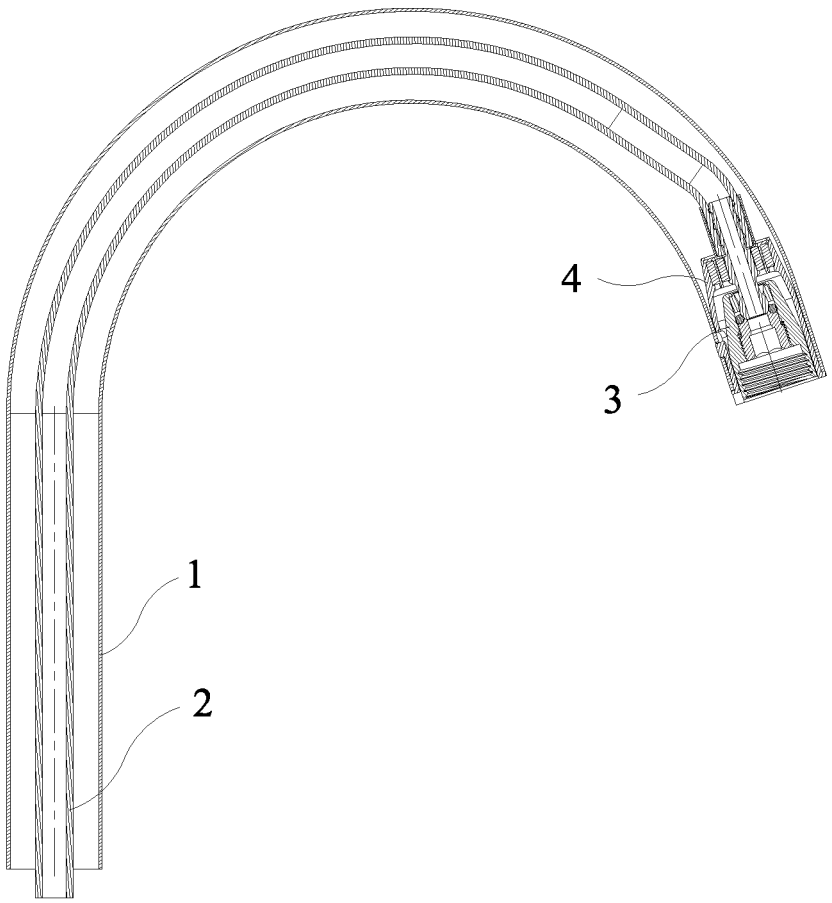
FIG. 1 is a sectional view in accordance with a first embodiment of the present invention.
Figure 2:
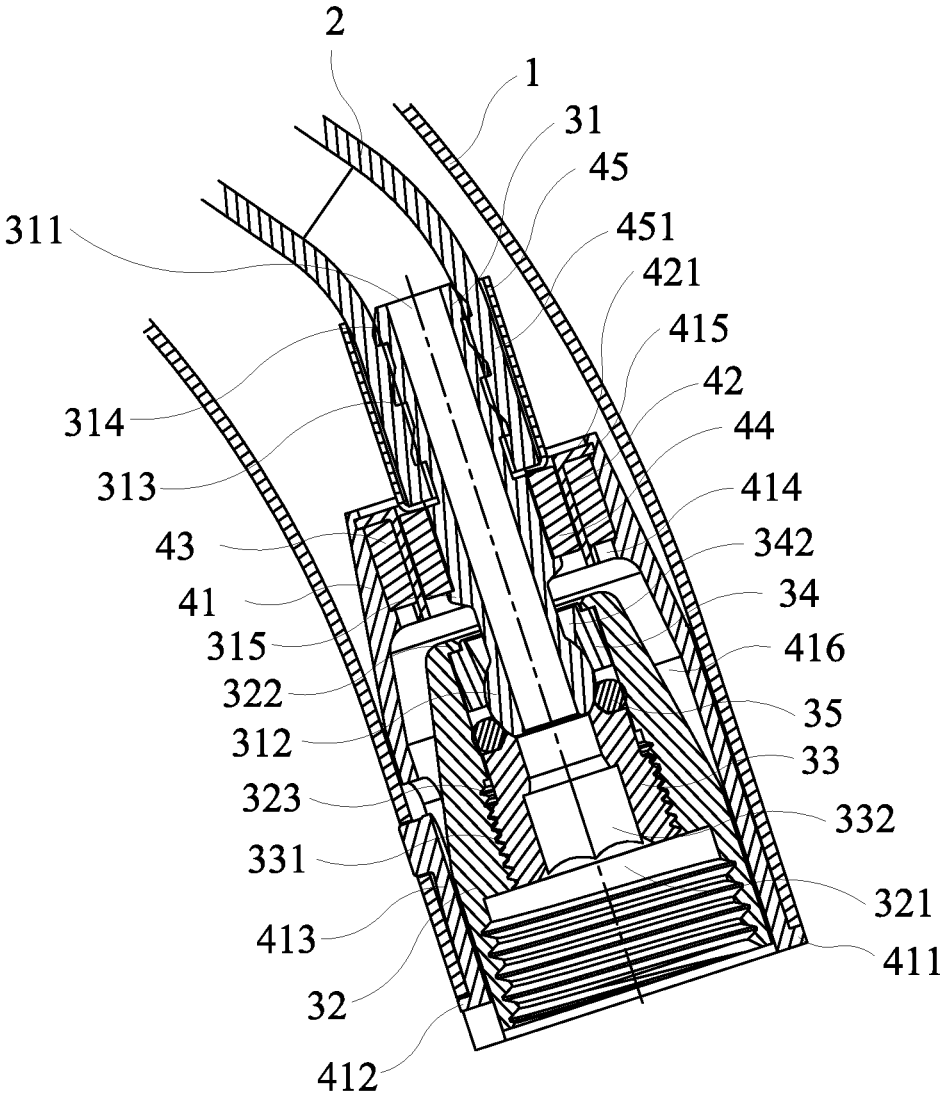
FIG. 2 is a partial sectional view in accordance with the first embodiment of the present invention.
Figure 3:
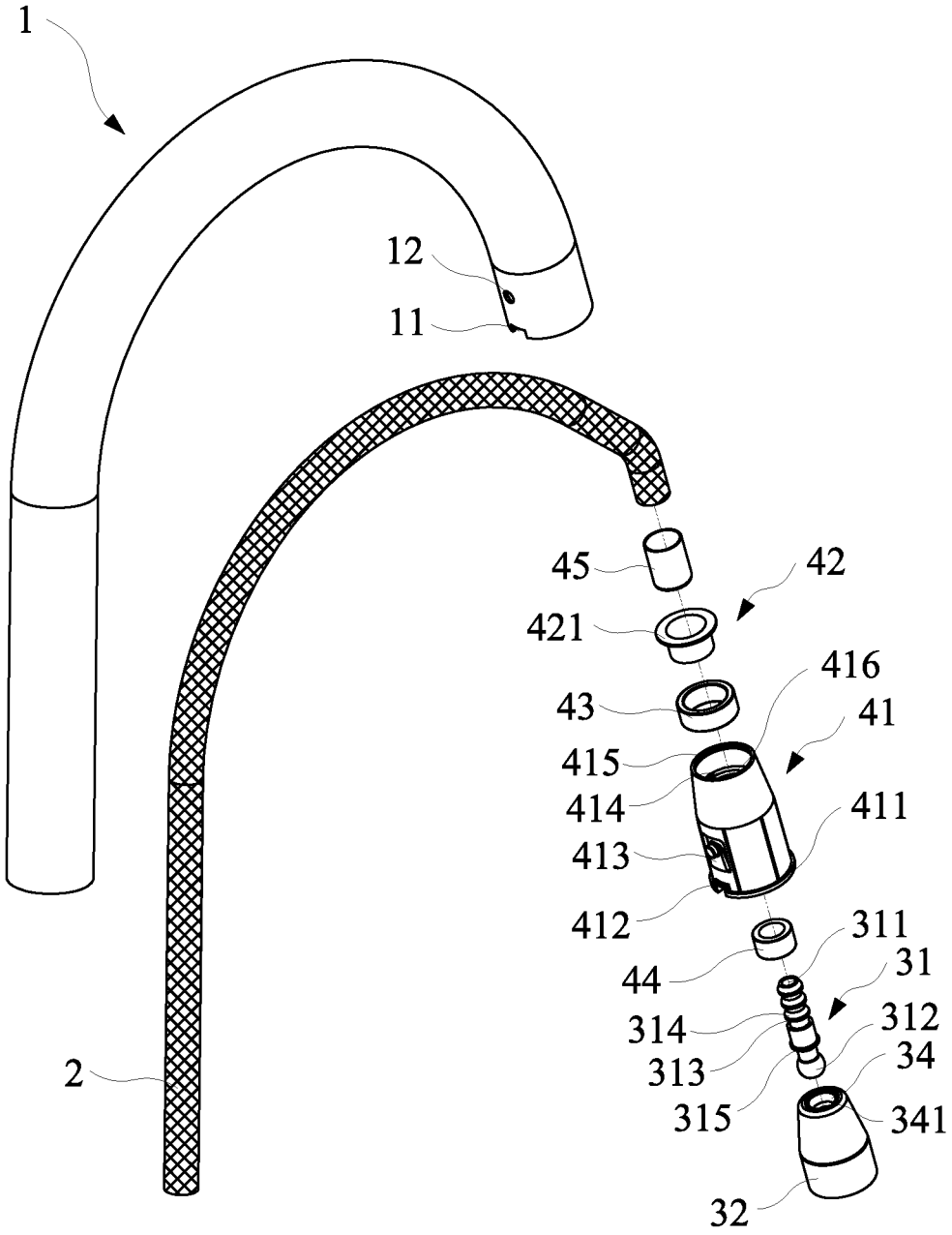
FIG. 3 is an exploded view in accordance with the first embodiment of the present invention.

As shown in FIGS. 1 to 3, a pull-out faucet having magnetic attraction according to a first embodiment of the present invention comprises a faucet body, a weight device, a faucet spout 1, a braided hose 2, and a spray head. The inlet end of the faucet spout 1 is fixedly connected to the faucet body. The braided hose 2 is movably disposed in the faucet spout 1. One end of the braided hose 2 is hermetically connected to the outlet end of the faucet body and is equipped with the weight device, and the other end of the braided hose 2 is hermetically connected to the spray head. The spray head is movably connected to the outlet end of the faucet spout 1.

The pull-out faucet having magnetic attraction of the present invention further comprises a coupling member 3 that is arranged in the faucet spout 1 and is hermetically connected to the outlet end of the braided hose 2. The spray head is movably connected to the outlet end of the faucet spout 1 through a hermetical connection with the outlet end of the coupling member 3.

The coupling member 3 includes a ball joint 31, a flared joint 32, a fixing nut 33, and an elastic collar 34. The ball joint 31 has a second through hole 311 through which water flows. The upper end of the ball joint 31 is hermetically connected to the outlet end of the braided hose 2. The lower end of the ball joint 31 is provided with a spherical portion 312 to be hermetically matched with and connected to the flared joint 32. The flared joint 32 has a central mounting hole 321. The inner wall of the top of the mounting hole 321 is provided with a first blocking wall 322. The inner wall of the middle portion of the mounting hole 321 is provided with internal threads 323. The outer periphery of the fixing nut 33 is provided with external threads 331 matched with the internal threads 323. The fixing nut 33 has a central third through hole 332 through which water flows. The elastic collar 34 is placed on the top of the mounting hole 321. The upper end face of the elastic collar 34 abuts against the lower end face of the first blocking wall 322. Because the elastic collar 34 has elasticity, the spherical portion 312 of the ball joint 31 can be forced to pass through the elastic collar 34. Alternatively, the elastic collar 34 has a cutout 341 to facilitate the spherical portion 312 of the ball joint 31 to pass through the elastic collar 34 and to be placed in the mounting hole 321. Then, through the threaded fit of the fixing nut 33 and the mounting hole 321, the fixing nut 33 is locked towards the top of the mounting hole 321 until the ball joint 31 is locked on the elastic collar 34.

The coupling member 3 further includes a sealing ring 35. The sealing ring 35 is disposed in the mounting hole 321. The inner side of the sealing ring 35 is tightly attached to the junction of the fixing nut 33 and the ball joint 31. When the fixing nut 33 locks the ball joint 31 on the elastic collar 34, the sealing ring 35 is pressed simultaneously. The sealing ring 35 is pressed between the spherical portion 312 and the fixing nut 33. The inner side of the sealing ring 35 is closely attached to the junction of the fixing nut 33 and the ball joint 31, so that the fixing nut 33 and the ball joint 31 can be hermetically connected through the sealing ring 35 to prevent water seepage at the junction to affect the use.

The center of the elastic collar 34 is provided with an upper slope 342 which is tapered downwardly. In use, because the elastic collar 34 is made of a soft material with elasticity, the spherical portion 312 of the ball joint 31 can rotate around the upper slope 342 without affecting the use. Therefore, this can prevent the ball joint 31 from excessively squeezing the elastic collar 34 to accelerate the wear and aging of the elastic collar 34. As a result, the junction of the ball joint 31 and the elastic collar 34 is leaking and cannot be used, shortening the service life of the faucet.

In addition, the hermetical connection of the ball joint 31 and the flared joint 32 can be achieved by setting the ball joint 31 and the flared joint 32 into an integral structure. The second through hole 311 of the ball joint 31 communicates with the mounting hole 321 of the flared joint 32. Through the integral structure, the production, processing and installation of related components are reduced, so as to reduce the cost.

The bottom of the flared joint 32 is hermetically connected to the spray head. The hermetical connection may be in various ways. For example, as shown in the figures, the bottom of the flared joint 32 is provided with internal threads, and the inlet end of the spray head has external threads to match the internal threads. The flared joint 32 and the spray head are hermetically connected together by a threaded fit. The flared joint 32 and the spray head can be fixed by direct welding, or the flared joint 32 and the spray head are hermetically connected by a snap-fit configuration.

The inlet end of the ball joint 31 is provided with an annular protrusion 313. The ball joint 31 is inserted into the outlet end of the braided hose 2. The annular protrusion 313 is connected to the outlet end of the braided hose 2 by interference fit. The outer side wall of the annular protrusion 313 is closely attached to the inner wall of the outlet end of the braided hose 2 to enhance the tightness and connection strength of the connection between the ball joint 31 and the braided hose 2, so as to avoid the ball joint 31 from being separated from the braided hose 2 when in use and to prevent water leakage at the junction of the ball joint 31 and the braided hose 2. In this embodiment, the inlet end of the ball joint 31 is provided with three annular protrusions 313. By increasing the number of annular protrusions 313, the tightness and connection strength of the ball joint 31 and the braided hose 2 are further strengthened. Furthermore, one end of the annular protrusion 313, close to the inlet end, has an upper insertion slope 314 which is gradually expanded downwardly, outwardly. The outer diameter of the upper insertion slope 314 is less than the inner diameter of the braided hose 2, which is beneficial for inserting the ball joint 31 into the braided hose 2.

The pull-out faucet having magnetic attraction of the present invention further comprises a fixing assembly 4. The fixing assembly 4 is disposed in the faucet spout 1 and sleeved on the coupling member 3. The fixing assembly 4 includes a fixing seat 41, a retaining member 42, a first fixing member 43, and a second fixing member 44 having a magnetic attraction with the first fixing member 43.

The fixing seat 41 is disposed in the faucet spout 1 and has a central first through hole 416. The coupling member 3 is movably inserted through the first through hole 416. A second blocking wall 411 is provided on the outer side of the bottom of the fixing seat 41. When the fixing assembly 4 is assembled in the faucet spout 1, the second blocking wall 411 is configured to abut against the underside of the outlet end of the faucet spout 1, so as to avoid that the fixing assembly 4 cannot be taken out due to excessive insertion into the faucet spout 1.

The bottom of the fixing seat 41 is provided with a positioning protrusion 412. The bottom of the outlet end of the faucet spout 1 is provided with a positioning notch 11 corresponding to the positioning protrusion 412. When the fixing assembly 4 is assembled in the faucet spout 1, through the cooperation between the positioning protrusion 412 and the positioning notch 11, the installation position of the fixing assembly 4 in the faucet spout 1 can be quickly determined, thereby preventing the fixing assembly 4 from rotating in the faucet spout 1 to affect the use.

One side of the fixing seat 41 is provided with an elastic engaging seat 413. One side of the faucet spout 1 is provided with an engaging hole 12 corresponding to the engaging seat 413. When the fixing assembly 4 is assembled in the faucet spout 1, the elastic engaging seat 413 is pressed toward the engaging hole 12 for the fixing assembly 4 to be inserted into the faucet spout 1. When inserted into the position of the engaging hole 12, the elastic engaging seat 413 springs upward and is engaged in the engaging hole 12, so as to prevent the fixing assembly 4 from detaching from the faucet spout 1, and to quickly determine the installation position of the fixing assembly 4 in the faucet spout 1 according to the relative positions of the elastic engaging seat 413 and the engaging hole 12, and to prevent the fixing assembly 4 from rotating in the faucet spout 1 to affect the use. Furthermore, through the cooperation between the elastic engaging seat 413 and the engaging hole 12, the fixing assembly 4 can be detachably assembled in the faucet spout 1, which is beneficial for installation and maintenance when in use. In the prior art, the fixing assembly 4 and the faucet spout 1 are provided with threads and they are threadedly connected to each other. Because of the threads, it is necessary to increase the thickness of the fixing assembly 4 and the faucet spout 1, and it also increases the volume and weight, resulting in an increase in cost.

The retaining member 42 is fitted on the coupling member 3, and the top of the retaining member 42 is provided with a tightening flange 421. The first fixing member 43 is sleeved on the outer periphery of the retaining member 42. The top surface of the first fixing member 43 abuts against the underside of the tightening flange 421. The inner wall of the fixing seat 41 is provided with a second protruding platform 414 and an engaging groove 415. The retaining member 42 with the first fixing member 43 is placed on the second protruding platform 414. The outer periphery of the retaining member 42 is connected to the second protruding platform 414 by interference fit. Through the cooperation between the engaging flange 421 and the engaging groove 415, the first fixing member 43 is secured between the retaining member 42 and the fixing seat 41. In the production process, the retaining member 42 is first formed by injection molding through the mold of the retaining member 42, and then the first fixing member 43 is sleeved on the outer periphery of the retaining member 42 and placed in the mold of the fixing seat 41 to form the fixing seat 41 by injection molding, so that the retaining member 42 and the fixing seat 41 are formed into an integral structure by double injection molding, and the first fixing member 43 is fixed between the retaining member 42 and the fixing seat 41.

The ball joint 31 is provided with a first protruding platform 315. The upper end face of the first protruding platform 315 is flush with the upper end face of the second protruding platform 414. The second fixing member 44 is mounted on the ball joint 31 and placed on the upper end face of the first protruding platform 315. After the ball joint 31 is inserted into the braided hose 2, the outlet end of the braided hose 2 can press the second fixing member 44 onto the ball joint 31.

The fixing assembly 4 further includes a sleeve 45. The sleeve 45 is fitted on the ball joint 31 and placed on the upper end face of the second fixing member 44. A space 451 is defined between the sleeve 45 and the ball joint 31 for the braided hose 2 to be inserted therein. In the process of inserting the ball joint 31 into the braided hose 2, the outlet end of the braided hose 2 pushes the sleeve 45 toward the second fixing member 44 until the second fixing member 44 is pressed onto the ball joint 31 by the sleeve 45. By providing the sleeve 45, it is possible to avoid a poor fixing effect of the second fixing member 44 because of the thin wall and the soft material of the braided hose 2 to affect the fixing effect of the second fixing member 44. Furthermore, the braided hose 2 can be pressed against the ball joint 31 through the sleeve 45, which further enhances the tightness and connection strength of the connection between the ball joint 31 and the braided hose 2, so as to avoid the ball joint 31 from being separated from the braided hose 2 when in use and to prevent water leakage at the junction of the ball joint 31 and the braided hose 2.

The magnetic attraction of the first fixing member 43 and the second fixing member 44 is the mutual magnetic attraction between magnets or the mutual magnetic attraction between a magnet and a stainless iron. For example, the first fixing member 43 is a stainless iron, and the second fixing member 44 is a magnet. Alternatively, the first fixing member 43 is a magnet, and the second fixing member 44 is a magnet or stainless iron. The magnetic effect of the first fixing member 43 and the second fixing member 44 can connect the two together. Furthermore, a certain angle is defined between the second fixing member 44 sleeved on the ball joint 31 and the axis of the ball joint 31. The first fixing member 43 disposed between the retaining member 42 and the fixing seat 41 is parallel with the second fixing member 44. By setting a certain angle, when the second fixing member 44 approaches the first fixing member 43, the magnetic force of the first fixing member 43 relative to the second fixing member 44 not only attracts and secures the second fixing member 44 on the first fixing member 43, but also pulls the second fixing member 44 toward the inlet end until it is attracted and secured on the first fixing member 43.

When the pull-out faucet with magnetic attraction provided by the present invention is used, the spray head is pulled out from the faucet spout 1 by overcoming the gravity of the weight device, and then the valve is opened through the faucet body for use as desired. After use, the spray head is released, under the action of the weight of the weight device, the braided hose 2 pulls the spray head to the outlet end of the faucet spout 1 through the coupling member 3. At this time, the coupling member 3 also approaches the fixing assembly that is fixed inside the outlet end of the faucet spout 1. At the same time, the second fixing member 44 on the coupling member 3 also approaches the first fixing member 43 on the fixing assembly. When the distance is within the action range of the magnetic force, the magnetic force together with the weight of the weight device will pull the coupling member 3 towards the fixing assembly. Through the magnetic attraction between the first fixing member 43 and the second fixing member 44, the coupling member 3 is attracted and secured on the fixing assembly. First, this can avoid the defect that the friction between the components causes the weight of the weight device to fail to accurately return the spray head fixed on the coupling member 3 to the faucet spout 1. Secondly, it also avoids the defect that the spray head positioned on the faucet spout 1 shakes to affect the use.

Figure 4:
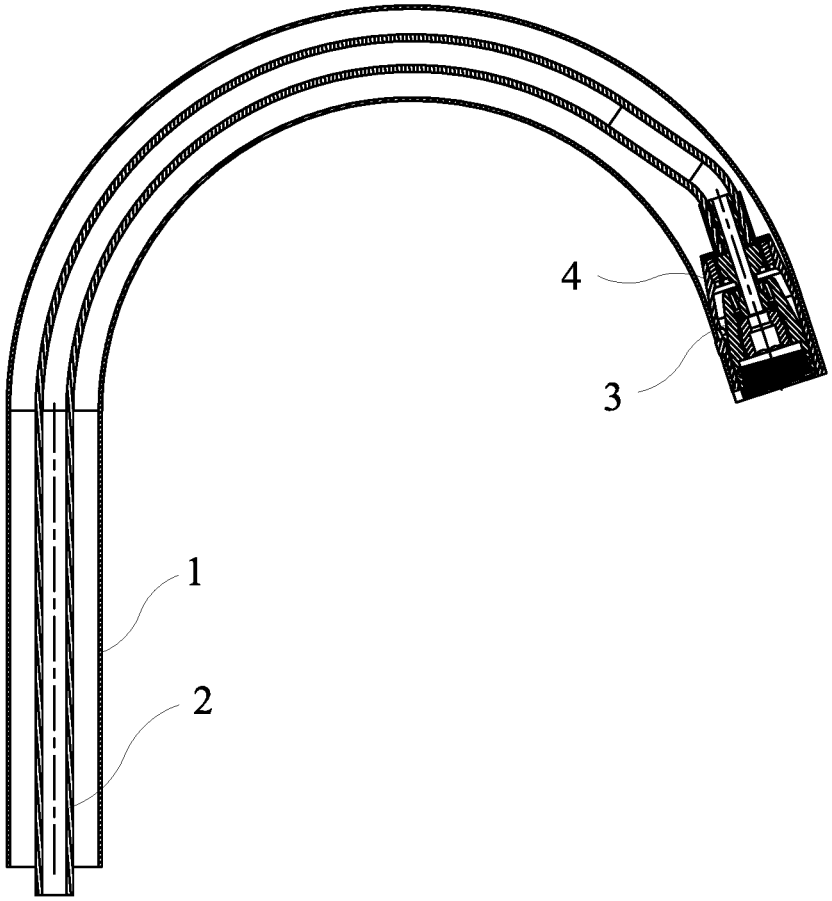
FIG. 4 is a sectional view in accordance with a second embodiment of the present invention.
Figure 5:
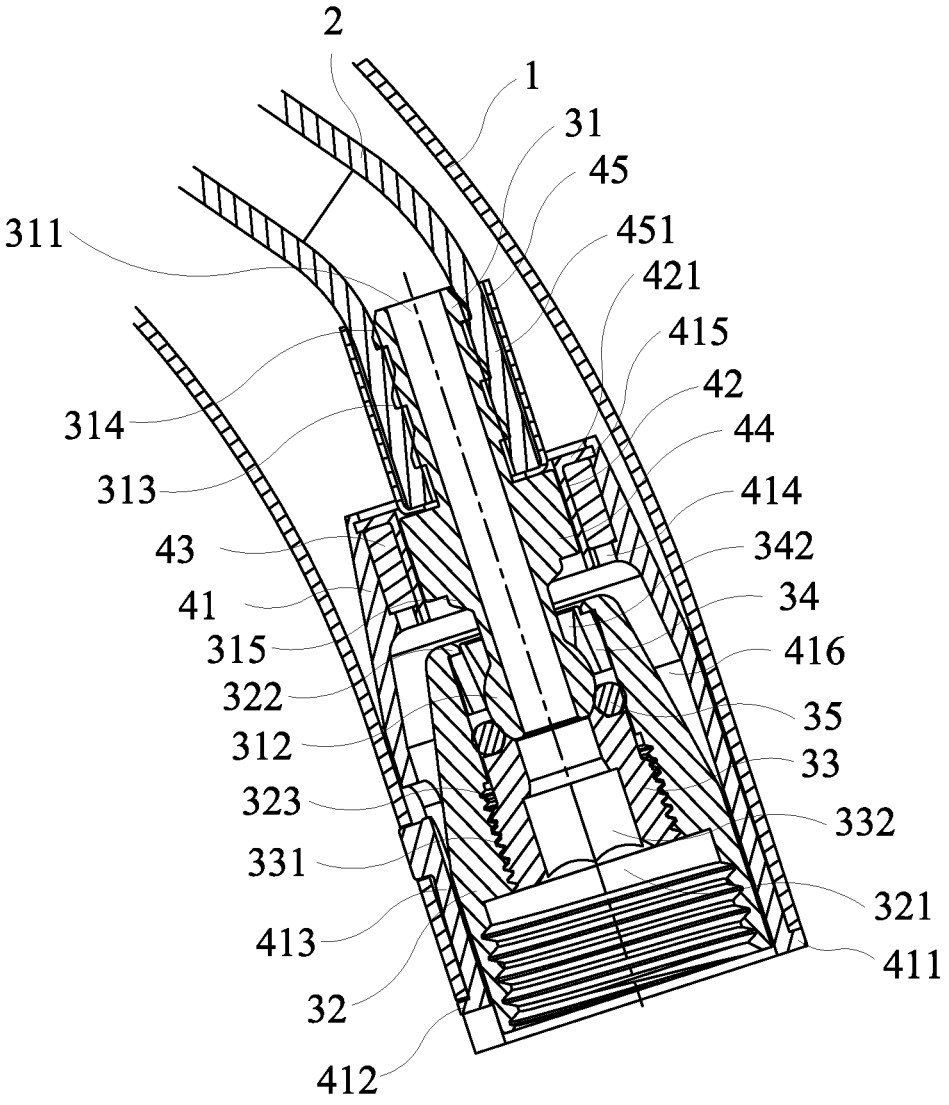
FIG. 5 is a partial sectional view in accordance with the second embodiment of the present invention.
Figure 6:
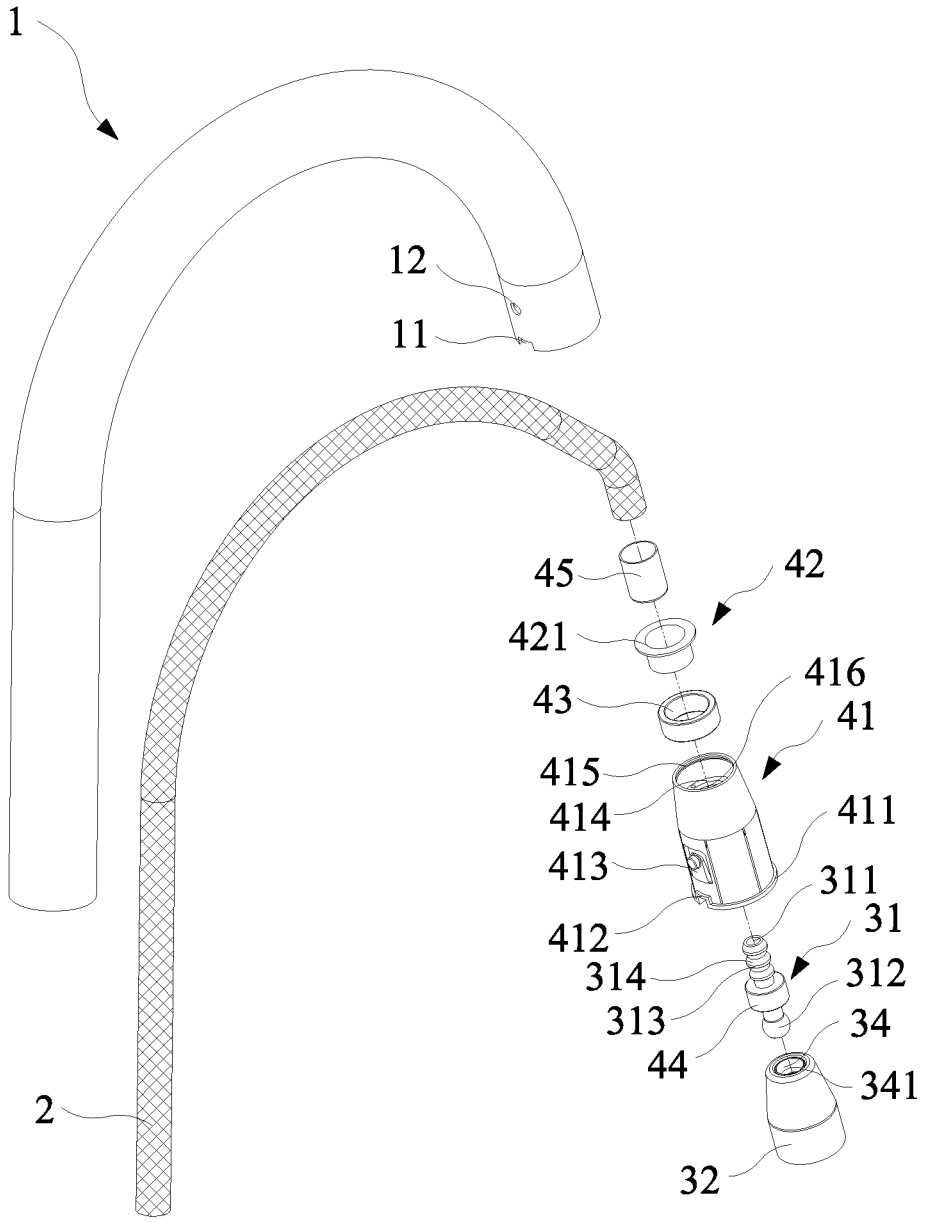
FIG. 6 is an exploded view in accordance with the second embodiment of the present invention.

FIGS. 4 to 6 illustrate a pull-out faucet having magnetic attraction according to a second embodiment of the present invention. The second embodiment is substantially similar to the first embodiment with the exceptions described hereinafter. In the second embodiment, the first fixing member 43 is a magnet, and both the second fixing member 44 and the ball joint 31 are stainless irons. The second fixing member 44 and the ball joint 31 are an integral structure. By arranging the second fixing member 44 and the ball joint 31 into an integral structure, the number of accessories of the pull-out faucet of the present invention is reduced, thereby reducing production costs and simplifying the installation steps.

Figure 7:
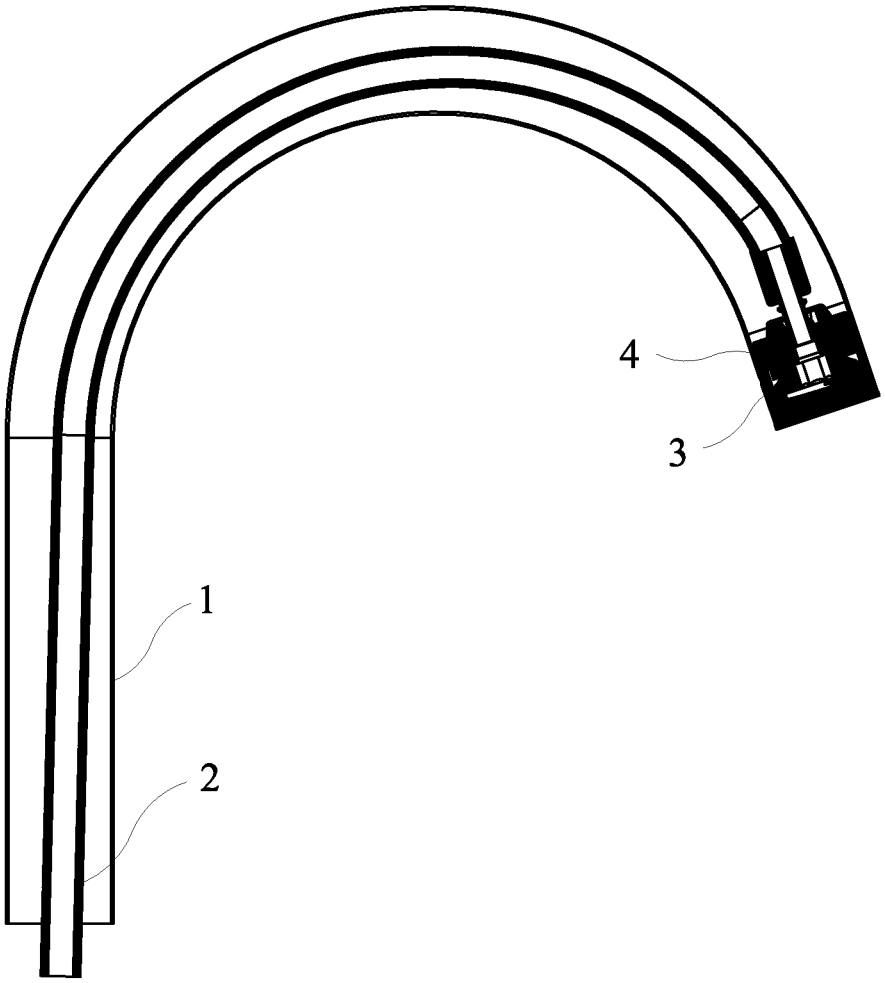
FIG. 7 is a sectional view in accordance with a third embodiment of the present invention.
Figure 8:
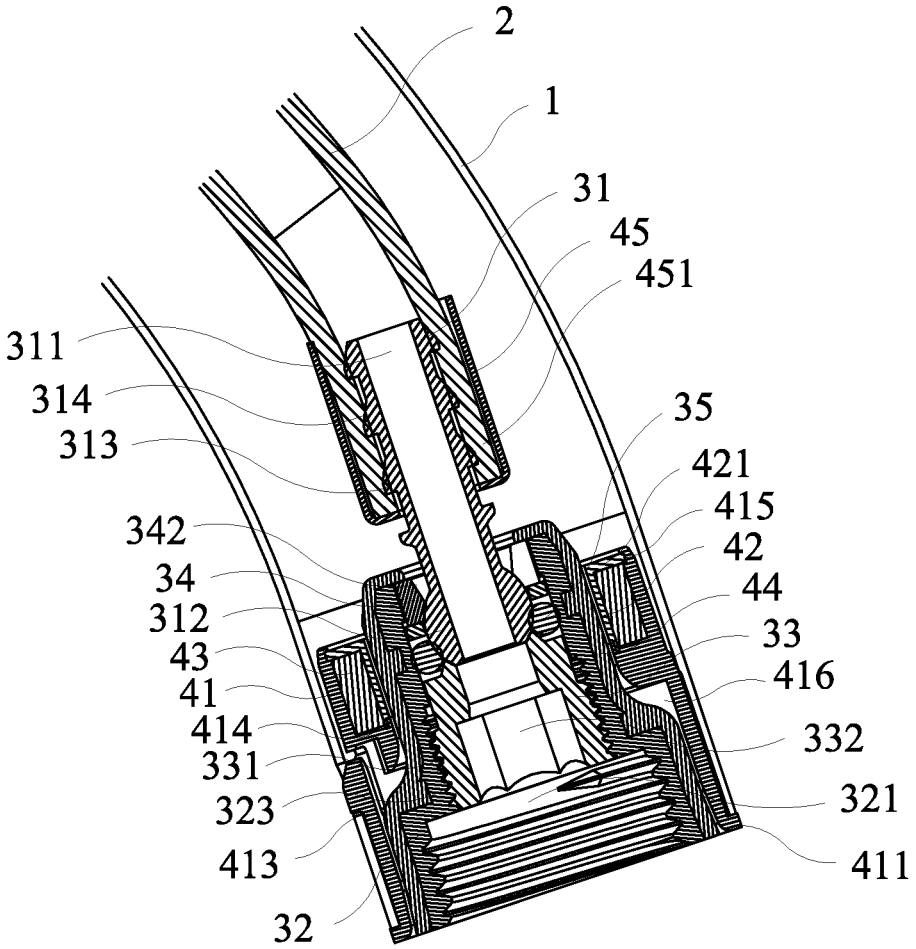
FIG. 8 is a partial sectional view in accordance with the third embodiment of the present invention.
Figure 9:
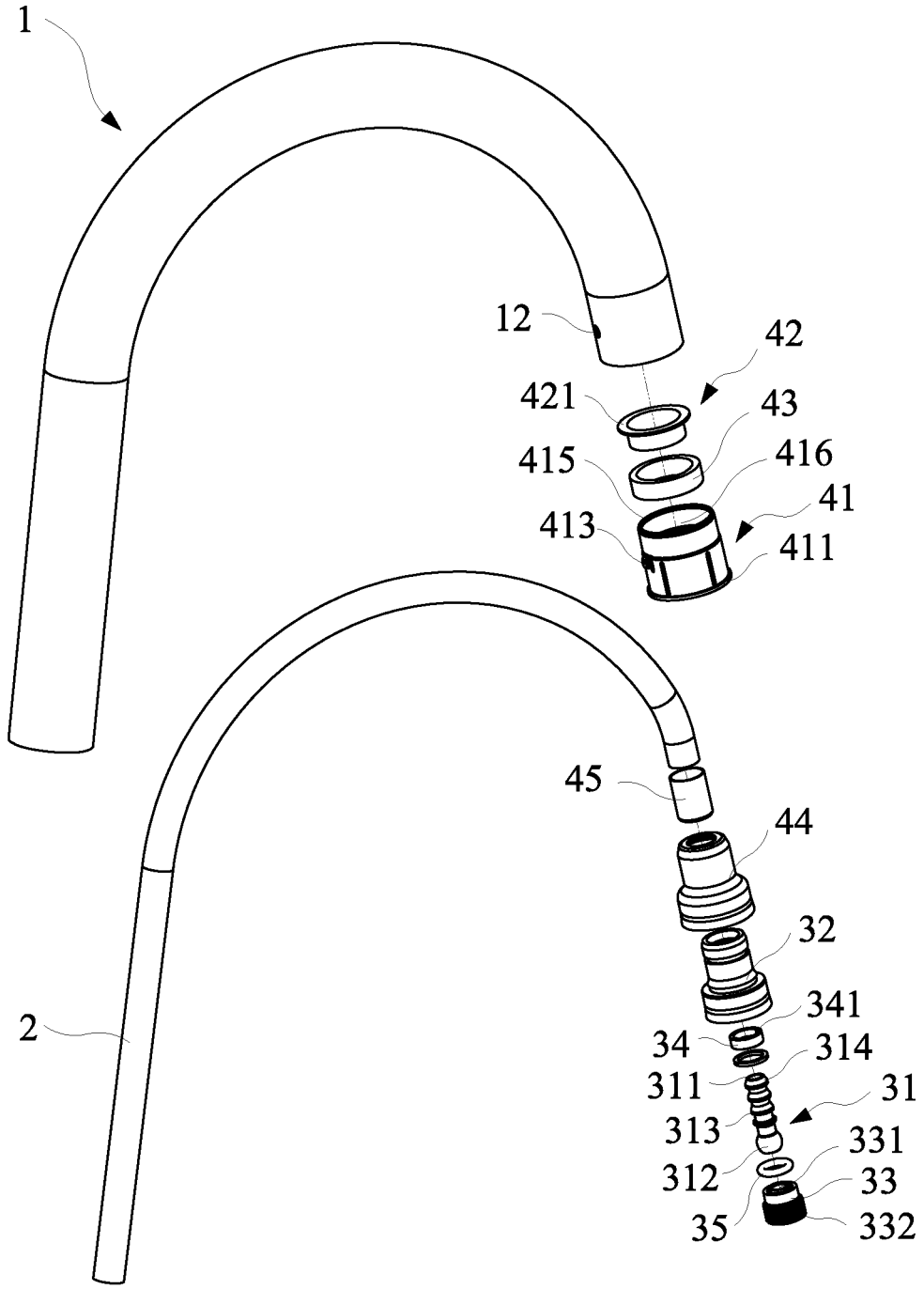
FIG. 9 is an exploded view in accordance with the third embodiment of the present invention.

FIGS. 7 to 9 illustrate a pull-out faucet having magnetic attraction according to a third embodiment of the present invention. The third embodiment is substantially similar to the first embodiment with the exceptions described hereinafter. In the third embodiment, the second fixing member 44 is fixedly installed on the outside of the flared joint 32 and is movably inserted through the first through hole 416 in the fixing seat 41. In use, this embodiment differs from the first embodiment in that: the second fixing member 44 on the flared joint 32 cooperates with the first fixing member 43 on the fixing seat 41. First, this can avoid the defect that the friction between the components causes the weight of the weight device to fail to accurately return the spray head fixed on the coupling member 3 to the faucet spout 1. Secondly, it also avoids the defect that the spray head positioned on the faucet spout 1 shakes to affect the use. In addition, in this embodiment, the second fixing member 44 is installed on the flared joint 32, so that the fixing seat 41 and the first fixing member 43 do not need to extend into the faucet spout 1 to the position of the ball joint 31, thereby reducing the volume of the fixing seat 41 and the production cost of the fixing seat 41.

Figure 10:
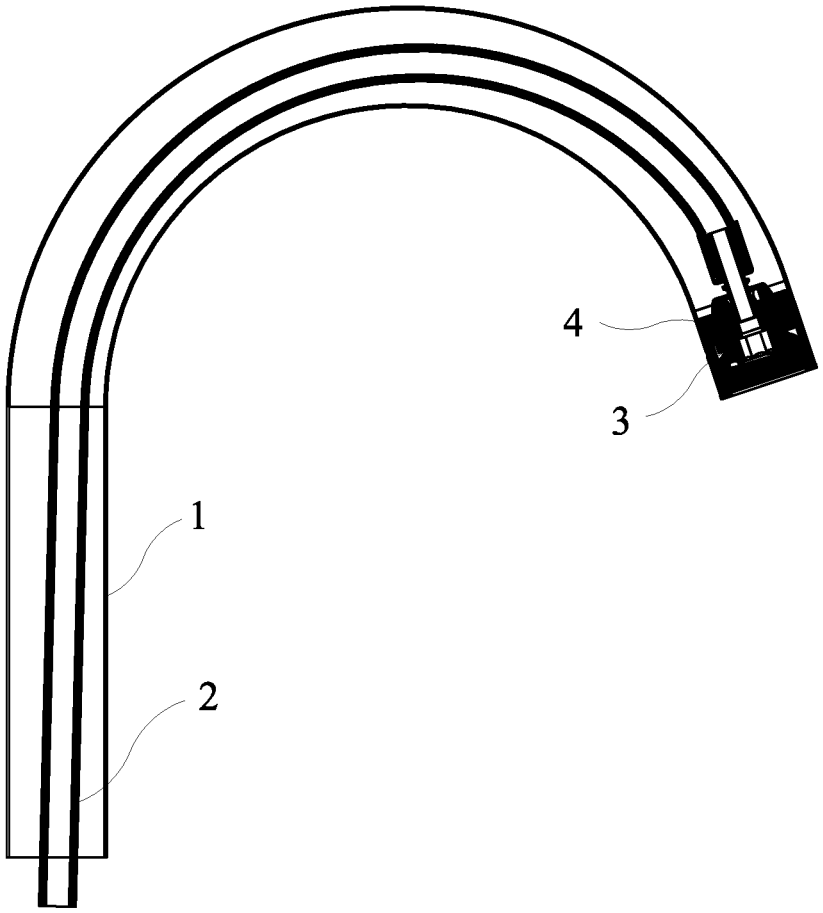
FIG. 10 is a sectional view in accordance with a fourth embodiment of the present invention.
Figure 11:
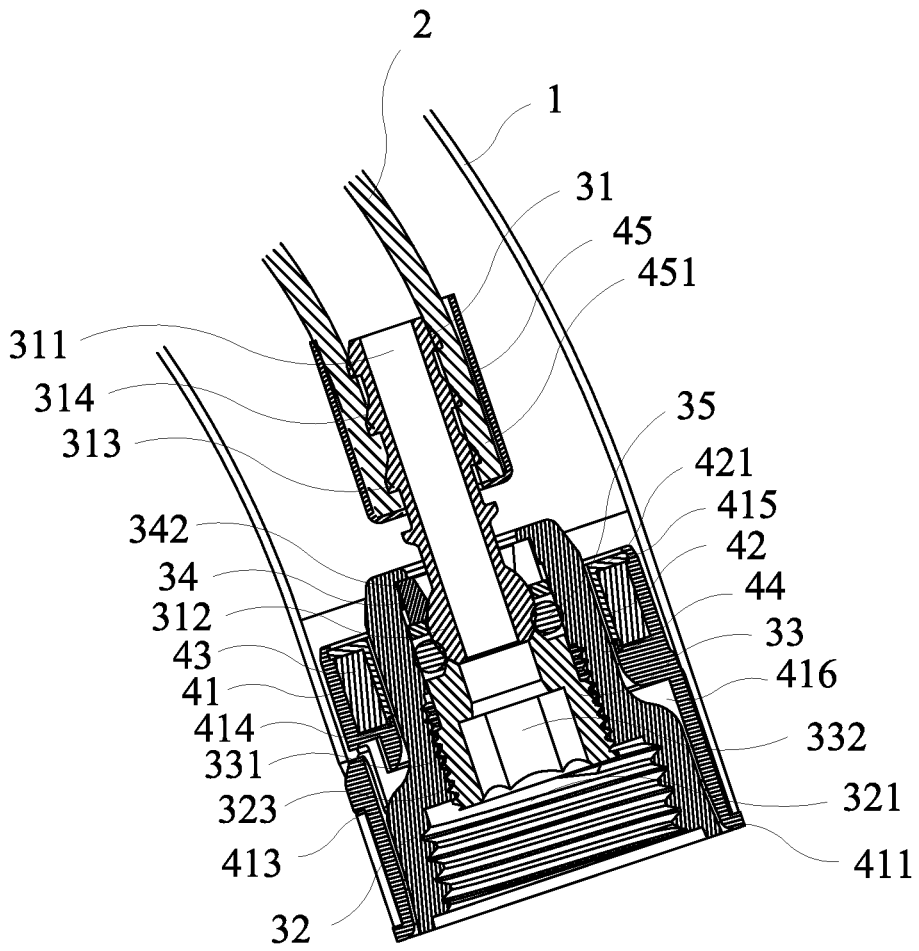
FIG. 11 is a partial sectional view in accordance with the fourth embodiment of the present invention.
Figure 12:
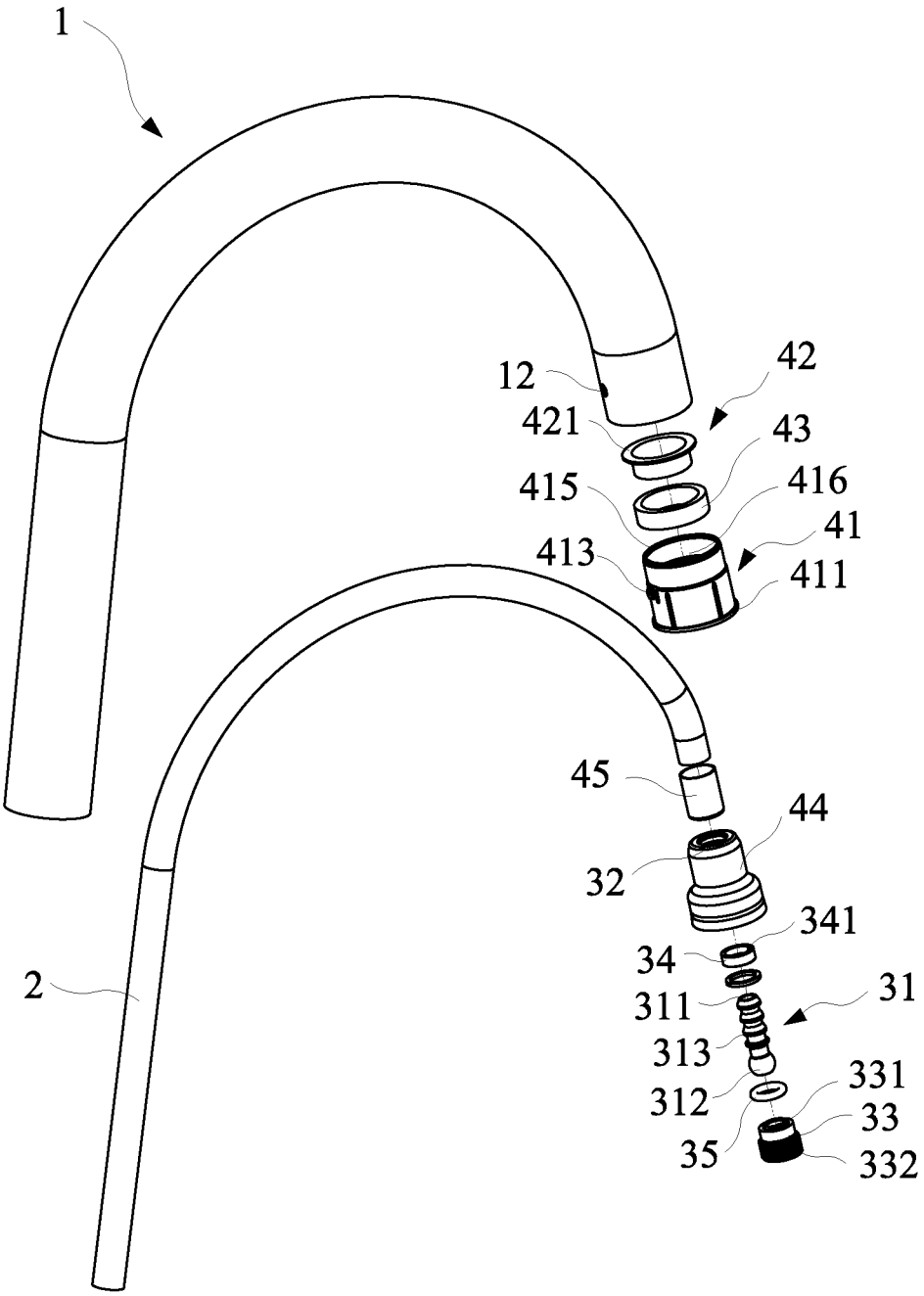
FIG. 12 is an exploded view in accordance with the fourth embodiment of the present invention.

FIGS. 10 to 12 illustrate a pull-out faucet having magnetic attraction according to a fourth embodiment of the present invention. The fourth embodiment is substantially similar to the third embodiment with the exceptions described hereinafter. In the fourth embodiment, the first fixing member 43 is a magnet, and both the second fixing member 44 and the flared joint 32 are stainless irons. The second fixing member 44 and the flared joint 32 are an integral structure. By arranging the second fixing member 44 and the flared joint 32 into an integral structure, the number of accessories of the pull-out faucet of the present invention is reduced, thereby reducing production costs and simplifying the installation steps.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A pull-out faucet, comprising a faucet spout, a braided hose that is movably disposed in the faucet spout, a coupling member that is disposed in the faucet spout and hermetically connected to an outlet end of the braided hose, and a fixing assembly; the fixing assembly including a fixing seat, a first fixing member, and a second fixing member having a magnetic attraction with the first fixing member, the fixing seat being disposed in the faucet spout and having a central first through hole, the coupling member being movably inserted through the first through hole, the first fixing member being secured in the fixing seat, the second fixing member being installed on the coupling member, wherein the coupling member comprises a ball joint having a first end that is connected to the outlet end of the braided hose and an opposite second end that defines a spherical configuration, wherein the second fixing member that is mounted on the second end of the ball joint and is spaced from the outlet end of the braided hose by a space circumferentially around a portion of the outlet end of the braided hose and the spherical configuration, such that the second fixing member is rotatable relative to the outlet end of the braided hose through spherically rotating along the spherical configuration.

2. The pull-out faucet as claimed in claim 1, wherein the ball joint of the coupling member includes a second through hole and the coupling member further comprises a flared joint having a central mounting hole, wherein an inlet end of the second through hole of the ball joint is hermetically connected to the outlet end of the braided hose, an outlet end of the second through hole of the ball joint is hermetically connected to the flared joint, and the second through hole of the ball joint communicates with the mounting hole of the flared joint.

3. The pull-out faucet as claimed in claim 2, wherein the ball joint and the flared joint are an integral structure.

4. The pull-out faucet as claimed in claim 2, wherein the second fixing member is installed on the ball joint and/or the flared joint.

5. The pull-out faucet as claimed in claim 4, wherein the second fixing member is installed on the ball joint and is arranged obliquely with respect to an axis of the ball joint, and the first fixing member is parallel with the second fixing member.

6. The pull-out faucet as claimed in claim 5, wherein the first fixing member is a magnet, the second fixing member and the ball joint are stainless irons, and the second fixing member and the ball joint are an integral structure.

7. The pull-out faucet as claimed in claim 4, wherein the second fixing member is installed on an outside of the flared joint and is movably inserted through the first through hole in the fixing seat.

8. The pull-out faucet as claimed in claim 7, wherein the first fixing member is a magnet, the second fixing member and the flared joint are stainless irons, and the second fixing member and the flared joint are an integral structure.

9. The pull-out faucet as claimed in claim 1, wherein the first fixing member and the second fixing member are magnets; or one of the first fixing member and the second fixing member is a stainless iron, and the other is a magnet.

10. The pull-out faucet as claimed in claim 1, wherein a bottom of the fixing seat is provided with a positioning protrusion, a bottom of an outlet end of the faucet spout is provided with a positioning notch, and the positioning protrusion is movably engaged in the positioning notch.

11. The pull-out faucet as claimed in claim 1, wherein one side of the fixing seat is provided with an elastic engaging seat, one side of the faucet spout is provided with an engaging hole, and the elastic engaging seat is detachably connected to the engaging hole.

12. The pull-out faucet as claimed in claim 1, wherein the fixing assembly further includes a sleeve, the sleeve is fitted on the coupling member and placed on an upper end face of the second fixing member, and a space is defined between the sleeve and the coupling member for the braided hose to be inserted therein.

* * * * *